United States Patent [19]

Bridges

[11] 4,404,163

[45] Sep. 13, 1983

[54] NEUTRON GENERATOR TUBE ION SOURCE CONTROL SYSTEM

[75] Inventor: James R. Bridges, Houston, Tex.

[73] Assignee: Halliburton Company, Duncan, Okla.

[21] Appl. No.: 212,915

[22] Filed: Dec. 3, 1980

[51] Int. Cl.[3] ..... G21G 4/02

[52] U.S. Cl. ..... 376/119

[58] Field of Search ..... 376/119

[56] References Cited

U.S. PATENT DOCUMENTS

| | | | |
|---|---|---|---|
| 3,176,136 | 3/1965 | Hopkinson | 376/119 |
| 3,719,827 | 3/1973 | Dennis | 376/119 |
| 3,973,131 | 8/1976 | Malone et al. | 376/119 |
| 3,984,694 | 10/1976 | Dennis | 376/119 |
| 4,042,545 | 5/1978 | Langford et al. | 376/119 |
| 4,288,696 | 9/1981 | Peelman et al. | 376/119 |

*Primary Examiner*—Sal Cangialosi

*Attorney, Agent, or Firm*—William J. Beard

[57] ABSTRACT

A pulsed neutron well logging system is disclosed having a novel ion source control system providing extremely sharply time defined neutron pulses. A low voltage input control pulse is utilized to produce a relatively sharp rising high voltage ion source control pulse. Simultaneously a delayed quenching circuit control pulse is produced to rapidly quench the high voltage ion source control pulse after a predictable time delay from its onset. The resultant ion source control voltage (and hence neutron output) is sharply defined timewise.

5 Claims, 3 Drawing Figures

NEUTRON GENERATOR TUBE ION SOURCE CONTROL SYSTEM

BACKGROUND OF THE INVENTION

Modern well logging techniques have led to the utilization of downhole pulsed neutron well logging systems. In particular, the measurement of earth formation thermal neutron decay times or thermal neutron lifetimes has become an important factor in determining residual oil saturations in earth formations in the vicinity of a well borehole. In copending application Ser. No. 182,172, filed Aug. 28, 1980 by Harold E. Peelman, and assigned to the assignee of the present invention, a thermal neutron decay time system is described which provides improved measurements of the thermal neutron lifetime of earth formations in the vicinity of a borehole. In the copending Peelman application, the thermal neutron lifetime measurements utilize a pulsed neutron source of the deuterium-tritium accelerator type and dual spaced detectors for making determinations of the thermal neutron lifetime of borehole and formation components of the thermal neutron lifetime simultaneously.

In making the measurements according to the techniques of the previously mentioned copending application, the pulsed neutron source is turned on and off at a rate of approximately 1000 pulses per second. Relatively short duration (10–30 microsecond) neutron pulses are used in this system. It has been found highly desirable to have precise control over the rise and fall time of the neutron pulses for making measurements according to the system of the aforementioned copending application. The present invention incorporates circuitry and techniques for assuring a very rapid rise time and very rapid fall time of neutron bursts emitted from a neutron generator of the deuterium-tritium accelerator type in a well borehole. The precise short rise and fall times of the neutron pulses are advantageous for thermal neutron decay time measurements and as well being advantageous for other types of pulsed neutron logging measurements such as carbon oxygen ratio inelastic scattering measurements.

BRIEF DESCRIPTION OF THE INVENTION

In the present invention, a downhole well logging system and surface equipment are disclosed for providing thermal neutron decay time measurements of the earth formation and borehole fluid in a well logging environment. In particular, the present invention concerns an ion source pulsing control circuit for use with a deuterium-tritium accelerator type neutron source. Control signals to pulse the ion source are provided from timing circuits in the well logging system and the ion source pulse circuit of the present invention provides a very rapidly rising voltage pulse with a very rapid decay time to the ion source in such a neutron generator tube. The very rapidly rising and falling ion source control voltage pulses are applied to the Penning type ion source utilized in deuterium-tritium accelerator tubes. The rapidly rising and rapidly falling control voltage pulse produces more clearly defined timewise bursts of high energy neutrons than has heretofore been possible with prior art neutron generator pulse control circuitry.

The present invention may best be understood by reference to the subsequent detailed description thereof when taking in conjunction with the accompanying drawings in which:

DESCRIPTION OF THE PREFERRED EMBODIMENT

Figure 1:
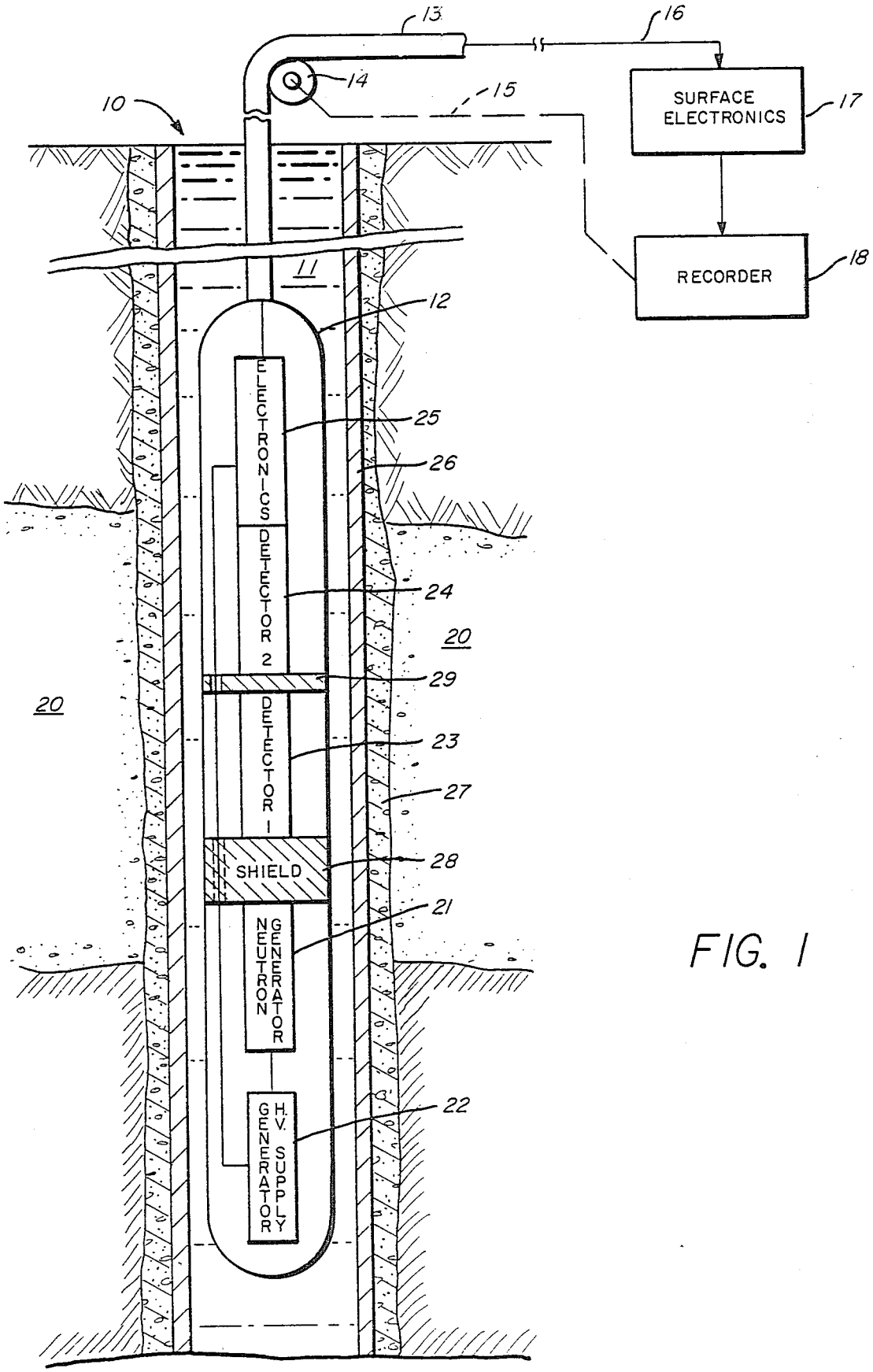
FIG. 1 is a schematic diagram illustrating a pulsed neutron logging system according to the present invention.

Referring initially to FIG. 1, a well logging system in accordance with the concepts of the present invention is illustrated schematically. A well borehole 10 is filled with borehole fluid 11 and penetrates earth formations 20 to be investigated. A downhole well logging sonde 12 is suspended in the borehole 10 via a conventional armored logging cable 13 in a manner known in the art and such that the sonde 12 may be raised and lowered through the borehole as desired. The well logging cable 13 passes over a sheave wheel 14 at the surface. The sheave wheel 14 is electrically or mechanically coupled, as indicated by dotted line 15, to a well logging recorder 18 which may comprise an optical recorder or magnetic tape recorder, or both, as known in the art. The record of measurements made by the downhole sonde 12 may thus be recorded as a function of the depth in the borehole 10 of the sonde 12.

In the downhole sonde 12, a neutron generator 21 is supplied with high voltage (approximately 100 kilovolts) for its operation by a high voltage power supply 22. Control and telemetry electronics 25 are utilized to supply control signals to the high voltage supply 22 and the neutron generator 21 and to telemeter information measured by the downhole instrument to the surface via the logging cable 13.

Longitudinally spaced from the neutron generator 21 are two radiation detectors 23 and 24. Radiation detectors 23 and 24 may comprise, for example, thallium activated sodium iodide crystals which are optically coupled to photomultiplier tubes. The detectors 23 and 24 serve to detect gamma radiation produced in the surrounding formations 20 and the borehole 10 resulting from the action of the neutron generator 21 in emitting pulses or burst of neutrons. A neutron shielding material 28 having a high density matter content or large scattering cross section is interposed between the neutron generator 21 and the dual spaced detectors 23 and 24 in order to prevent direct irradiation of the detectors by neutrons emitted by the neutron generator 21. Shielding 29 may also be interposed between the detectors 23 and 24, if desired.

Upon activation of the neutron generator 21, a burst or pulse of neutrons of from 10–30 microseconds duration is initiated and is emitted into the well borehole 10, the borehole fluid 11 and through the steel casing 26 and cement layer 27 surrounding the steel casing into earth formations 20 being investigated. The neutron burst is moderated or slowed down by scattering interactions such that the neutrons are all essentially at thermal energy in a short time. The thermalized or thermal neutrons then begin capture interactions with the elemental nuclei of constituents of the earth formations 20 pore spaces in the formations 20 and borehole fluid components in the borehole 10.

The capture of neutrons by nuclei of elements comprising the earth formations 20 and their pore spaces produce capture gamma rays which are emitted and which impinge upon detectors 23 and 24. A voltage pulse is produced from the photomultipliers of detectors 23 and 24 for each gamma ray so detected. These voltage pulses are supplied to the electronic section 25 where they are counted in a digital counter and telemetered to the surface via a conductor 16 of the well logging capable 13. At the surface, a surface electronics package 17 detects the telemetered information from the downhole sonde 12 and performs processing functions in order to determine the thermal neutron decay time of earth formations and borehole components or other measurement information such as elemental determinations of carbon and oxygen nuclei as desired. The surface electronics then supplies signals representative of the measured quantities to the well logging recorder 18 where they are recorded as a function of borehole depth of the downhole sonde 12.

Figure 2:
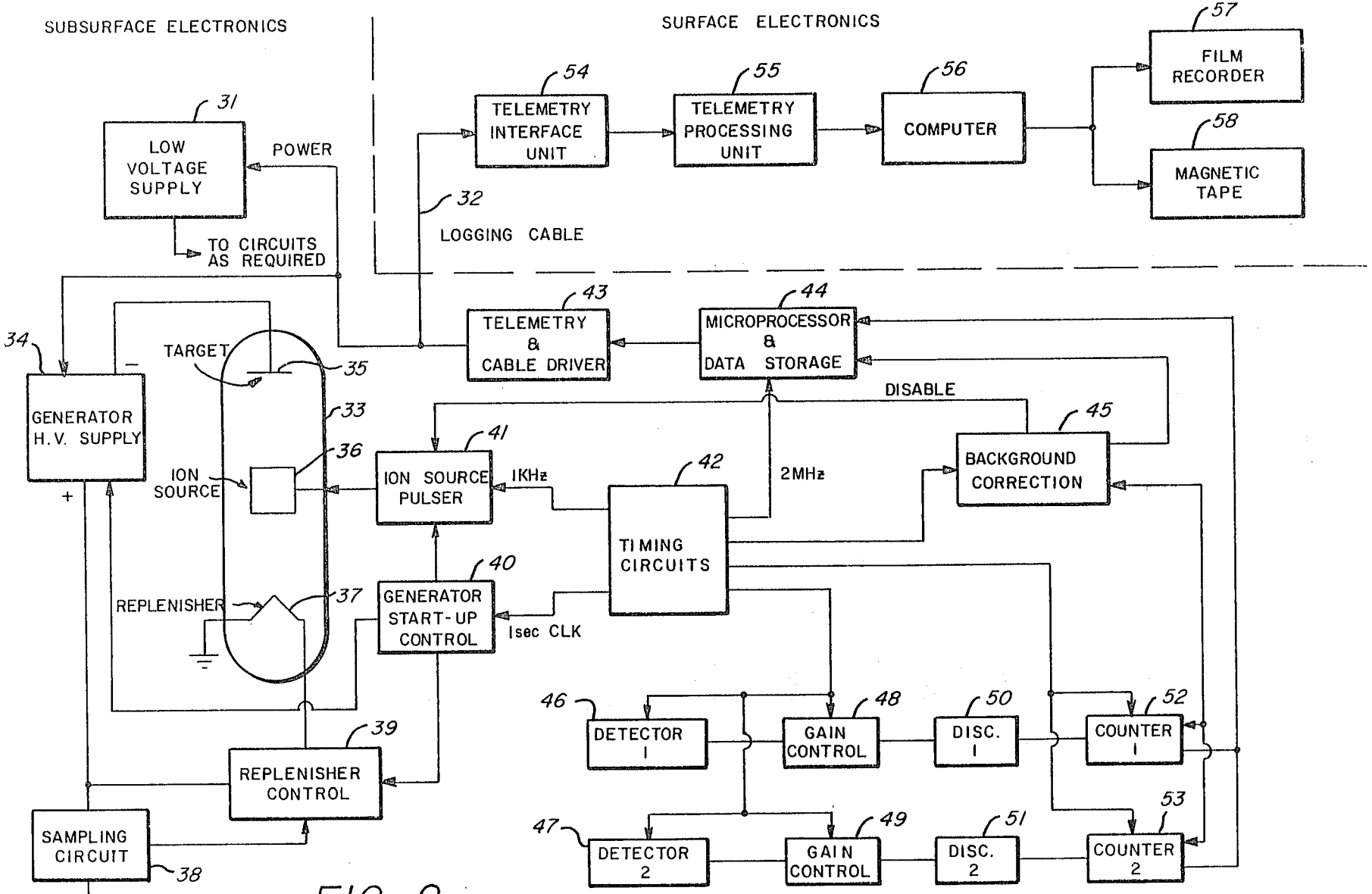
FIG. 2 is a schematic block diagram illustrating, the electronic systems associated with the well logging system according to the present invention.

Referring now to FIG. 2, a schematic block diagram illustrating in more detail the electronic portions of the system of FIG. 1 for measuring thermal neutron decay times is illustrated in more detail, but still schematically. Power for the operation of the subsurface electronics is supplied via a conductor of the well logging cable 32 to a conventional low voltage power supply 31 and a high voltage power supply 34. The high voltage power supply 34 may be of the Crockcroft-Walton multiple stage type and supplies approximately 100 kilovolts for the operation of the neutron generator tube 33. A replenisher heater 37 is impregnated with additional deuterium and maintains a pressure level of deuterium gas inside the tube 33 envelope sufficient to supply ion source 36 with deuterium gas for ionization. A target 35 is impregnated with tritium and is maintained at a relatively high negative 100 kilovolt potential. The ion source is controlled by an ion source pulsing circuit 41 which will be discussed in more detail subsequently. When supplied with a relativly low voltage pulse from pulsing circuit 41 via control circuits or timing circuits 42, the ion source 36 causes gas in the tube 33 envelope to become ionized and accelerated toward the target material 35. Upon impinging on the target material of target 35, the deuterium-ions interact thermonuclearly with the tritium nuclei in the target to produce neutrons which are then emitted in a generally spherically symmetrical fashion from the neutron generator tube 33 into the borehole and surrounding earth formations.

A replenisher control circuit 39 is supplied with samples of the neutron generator target current by a sampling circuit 38 and utilizes this to compare with a reference signal to control the replenisher current and thereby the gas pressure in the envelope of the neutron generator tube 33. Timing circuits 42 which comprise a master timing oscillator operating at a relatively high frequency and an appropriate divider chains, supplies 1 kilohertz pulses to the ion source pulsed control circuit 41 and also supplies 1 second clock pulses to the neutron generator startup control circuit 40. Moreover, timing circuit 42 supplies two megahertz clock pulses to a microprocessor and data storage array 44 and supplies timing pulses to the background circuit 45 and counters 52 and 53. Similarly, timing signals are supplied to a pair of gain control circuits 48 and 49.

The interaction of thermalized neutrons with nuclei of earth formations materials causes the emission of capture gamma rays which are detected by detectors 46 and 47 (corresponding to the dual spaced detectors 23 and 24 of FIG. 1). Voltage pulses from the detectors 46 and 47 are supplied to gain control circuits 48 and 49 respectively. The gain control circuits 48 and 49 serve to maintain the pulse height output of detectors 46 and 47 in a calibrated manner with respect to a known amplitude reference pulse. Output signals from the gain control circuits, corresponding to gamma rays detected by detectors 46 and 47, are supplied to discriminator circuits 50 and 51 respectively. The discriminator circuits 50 and 51 serve to prevent low amplitude voltage pulses from the detectors from entering the counters 52 and 53. Typically, the discriminators are set at about 0.1–0.5 MEV threshold level to eliminate noise generated by the photomultiplier tubes associated with detectors 46 and 47. The discriminator 50 and 51 outputs are supplied to counters 52 and 53 which serve to count individual capture gamma ray events detected by the detectors 46 and 47. Outputs from the counters 52 and 53 are supplied to the microprocessor and data storage circuits 44.

During a background portion of the detection cycle, a background circuit 45 is supplied with counts from the counters 52 and 53. This circuit also provides a disable pulse to the ion source control circuit 41 to prevent pulsing of the neutron generator during the background counting portion of the cycle. The background correction circuit 45, supplies background count information to microprocessor and data storage 44. Background may be stored and averaged for longer periods than capture data since at low discriminator thresholds most background is from gamma ray activation in the detector crystals (NaI) which has a 27 minute half life. Better statistics in the subtracted signals results.

Digital count information from counters 52 and 53 and background correction circuit 45 are supplied to the microprocessor and data storage circuit 44. Circuit 44 format the data and presents it in a serial manner to the telemetry circuit 43 which is used to telemeter the digital information from the counters and background correction circuit to the surface via well logging cable 32. At the surface, a telemetry interface unit 54 detects the analog telemetry voltage signals from the logging cable 32 conductors and supplies them to a telemetry processing unit 55 which formats the digital count rate information representating the counting rates from counters 52 and 53 in the subsurface equipment in a format more convenient for processing via surface computer 56.

The surface computer 56 may be programmed in accordance with a processing technique for extracting physical parameters indicative of the presence of hydrocarbons in the earth formations in the vicinity of a well borehole.

Thermal neutron decay or thermal neutron lifetime measurements of the borehole component and earth formation component in the vicinity of the borehole may result from such calculations. Alternatively, parameters such as the carbon and oxygen content of the earth formations may result from such processing. In any event, output signals representing formation parameters of interest are supplied from the computer 56 to a film recorder 57 and a magnetic tape recorder 58 for recording as a function of borehole depth.

Figure 3:
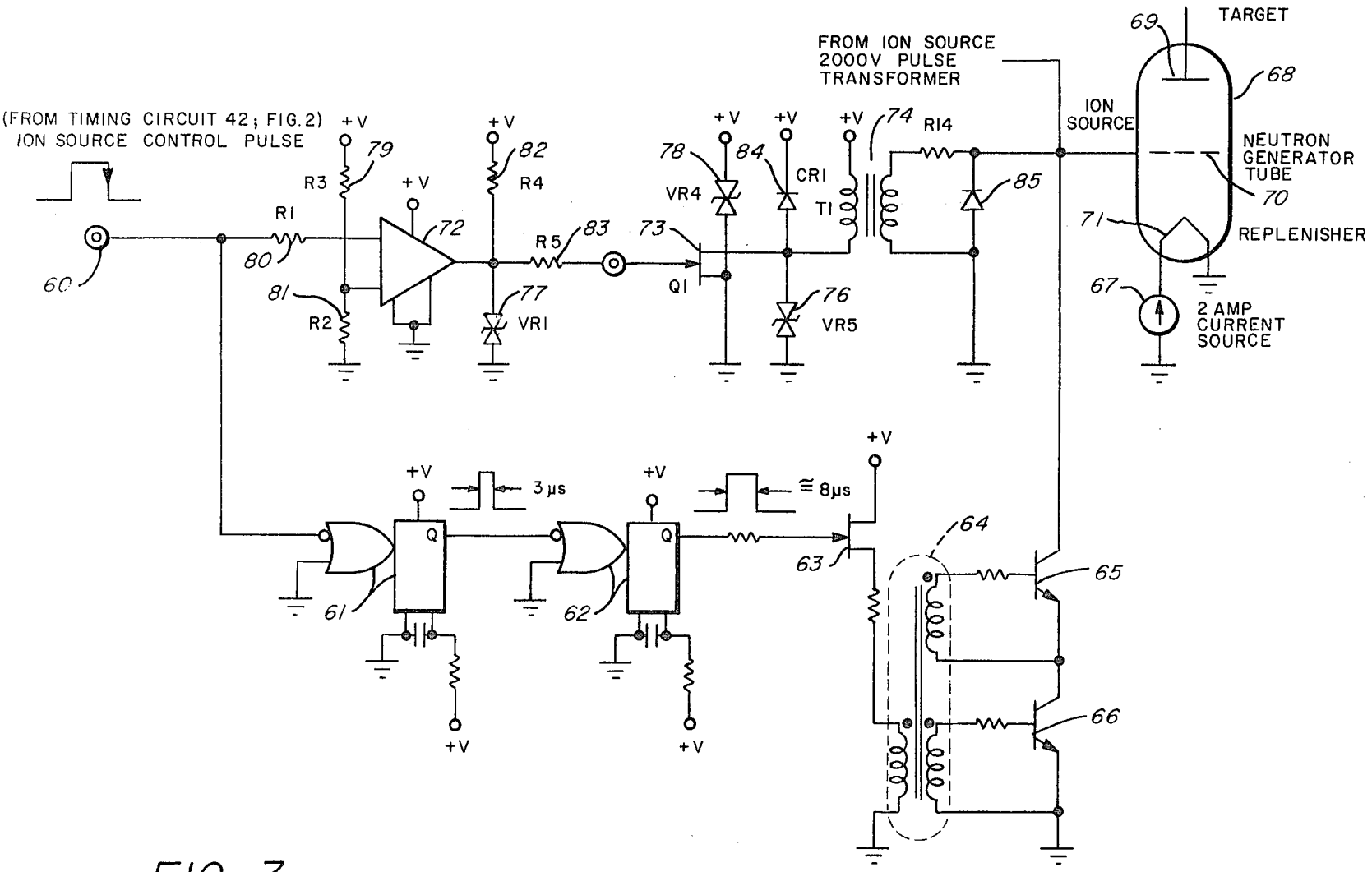
FIG. 3 is a schematic circuit diagram illustrating an ion source pulsing circuit according to the concepts of the present invention.

Referring now to FIG. 3, an ion source pulse control circuit (represented by 41 of FIG. 2) is illustrated in more detail, but still schematically. An input terminal 60 is supplied with a low voltage control pulse from timing circuit 42 of FIG. 2 as indicated. This control pulse signals the circuit of FIG. 3 to begin to turn on the 2,000 volt control voltage to the ion source 70 of the neutron generator tube 68 of FIG. 3. The neutron generator tube is supplied with a target high voltage on target 69 from the high voltage supply of FIG. 2. Additionally, a two ampere current source 67 supplies current to replenisher 71 of the neutron generator tube of FIG. 3.

The ion source control pulse generator circuit of FIG. 3 comprises a voltage comparator circuit 72, a power field effect transistor (FET) 73, a pulse transformer 74 and associated transient suppressor devices 76, 77, 78 and resistors 79–83.

In FIG. 3 an approximately 15 volt control pulse is applied to input terminal 60 having a duration of approximately 20 microseconds. This pulse is applied to voltage comparator circuit 72 and its associated components, resistors R1(80), R2(81), R3(79), R4(82) and R5(83) which acts as a non inverting buffer-driver for the VMOS power FET 73. The output of voltage comparator circuit 72 is also an approximately 15 volt pulse which has sufficient power to turn the VMOS power FET 73 on or off in less than 0.5 microseconds. This power FET 73 acts as a semiconductor single pole single throw switch. When power FET 73 is turned on a current path is provided in the primary winding of pulse transformer 74. When power FET 73 is turned off, there is no current flow in the primary winding of transformer 74. When the power FET 73 is turned on and then (approximately 10–30 microseconds later) turned off, a 2000 volt pulse is produced in the secondary winding of pulse transformer 74 which is applied to the ion source 70 of the neutron generator tube 68.

Transient suppressors 76, 77 and 78 are used to prevent damage to sensitive components. When the current in the primary winding of the transformer 74 is abruptly interrupted, the well known flyback voltage pulse is induced in the primary winding of transformer 74. Diode 84 dampens or dissipates the energy stored in transformer 74 and transient suppressors 76, 77 and 78 clamp the fly back pulse at a safe level to prevent damage to power FET 73 and voltage comparator 72. Diode 85 in the secondary of transformer 74 insures that the voltage applied to ion source 70 of tube 68 has the proper polarity for its operation.

The control circuit of FIG. 3 further comprises time delay logic circuits 61 and 62, power field effect transistor 63, isolation transformer 64 and two high voltage bipolar transistors 65 and 66, which act to rapidly quench the ion source 70 control voltage pulse at the proper time.

The purpose of the time delay logic circuit, which comprises one shots 61 and 62, is to insure that the high voltage power transistors 65 and 66 are turned on at the proper time after power FET 73 has acted. Two COSMOS one-shots, 61 and 62, are connected in series. The first one shot 61 is triggered by the falling edge of the ion source control pulse from input terminal 60. The falling edge of the ion source control pulse from terminal 60 occurs approximately 3 microseconds before the 2000 volt ion source pulse begins to fall. This delay, compensated for by the time delay logic is propagation delay through the pulse generator circuit previously described and the pulse transformer 74. The output pulse width of the first one shot 61 is set to approximately 3 microseconds. This represents the propagation delay of the circuits and is a positive voltage pulse. The second one shot 62 is triggered by the falling edge of the first one shot output pulse. This occurrs 3 microseconds after the falling edge of the ion source input control pulse at 60 due to the delay provided by one shot circuit 61. The output pulse width of the second one shot 62 is set to approximately 8 microseconds duration. This output pulse from the second one shot 62 forms the gate drive signal for the power field effect transistor (FET) 63.

The eight microsecond pulse from the second one shot 62 turns on the power FET 63 which in turn applies current to isolation transformer 64 primary winding. Current in the primary winding of isolation transformer 64 causes induced current to flow in its two secondary windings. These secondary winding currents cause current to flow from the base to the emitter of both of the high voltage bipolar transistors 65 and 66 causing both transistors to turn on.

When both high voltage transistors 65 and 66 are turned on they provide a very low resistance path from the ion source 70 of neutron generator tube 68 to ground. This causes the ion source voltage pulse induced in the secondaries of the ion source pulse transformer 74 and applied to ion source 70 to shut off or quench rapidly. Two high voltage transistor 65 and 66 are used to share the approximately 2000 volt ion source pulse produced by transformer 74. This 2000 volts exceeds the normal voltage breakdown rating of each separate transistor. However, when two transistors are connected in series they will withstand the 2000 volt pulse.

Using this ion source control circuit, just described, the fall time of the ion source pulse is approximately 0.8 microseconds. Without the two fast switching high voltage transistors 65 and 66, the fall time of the 2000 volt pulse provided by the secondary winding of transformer 74 would be approximately 10 microseconds. Thus, it is seen that the foregoing ion source pulse control circuit provides an extremely sharp time resolution on the 2000 volt generator control pulse supplied to the ion source 70 of the neutron generator tube 68. This provides for a much sharper defined, in time duration, neutron output from the tube 68 than would otherwise be obtainable.

The foregoing descriptions may make other alternative embodiments in accordance with the concepts of the present invention apparent to those skilled in the art. The aim of the appended claims is to cover all such changes and modifications as fall within the true spirit and scope of the invention.

I claim:

1. A system for controlling the output of a neutron generator tube of the deuterium-tritium accelerator type and having a replenisher and an ion source to produce sharply timewise defined pulsed of neutrons for well logging use, comprising:

means for inputting a relatively low voltage input control pulse to said ion source said control pulse having approximately a square wave waveform;

means for amplifying said input control pulse to provide an amplified switching pulse;

first electronic switching means, responsive to said amplified switching pulse, for controlling a voltage source applied to a primary winding of a relatively high voltage pulse transformer having a secondary winding operably connected to said ion source;

delay means responsive to said input control pulse for producing a time delayed secondary control pulse in response thereto; and second electronic switching means operably connected to said ion source and responsive to said time delayed control pulse for controlling an electronic quenching means operably connected to said secondary winding of said pulse transformer, whereby said first and second electronic switching means operate in timed relationship with each other to produce a rapidly rising relatively high voltage pulse in said secondary winding of said pulse transformer which is applied to said ion source and which is rapidly quenched in a timed relationship by said quenching means.

2. The system of claim 1 wherein said quenching means comprises a buffer transformer and at least one solid state switching transistor connected in series relationship with the secondary winding of said pulse transformer and ground.

3. The system of claim 2 wherein said quenching means functions by supplying a very low resistance ground path to the secondary winding of said pulse transformer upon turning on said at least one solid state switching transistor in response to said secondary control pulse.

4. The system of claim 1 wherein said delay means responsive to said input control pulse provides a delay at least as long as the propagation delay of said amplifying means, said first switching means and said primary winding of said pulse transformer for pulses of the operating frequency of these circuits.

5. The system of claim 1 and further including transient suppressor means in the primary winding circuit of said pulse transformer.

* * * * *